United States Patent [19]

Coulon

[11] 4,348,168

[45] Sep. 7, 1982

[54] PROCESS AND APPARATUS FOR ATOMIZING AND BURNING LIQUID FUELS

[76] Inventor: Christian Coulon, Wenckstrasse 56, D 61 Darmstadt, Fed. Rep. of Germany

[21] Appl. No.: 244,580

[22] Filed: Mar. 17, 1981

Related U.S. Application Data

[63] Continuation of Ser. No. 839,060, Oct. 3, 1977, abandoned, which is a continuation of Ser. No. 678,634, Apr. 20, 1976, abandoned.

[30] Foreign Application Priority Data

Apr. 22, 1975 [DE] Fed. Rep. of Germany ..... 2517756

[51] Int. Cl.[3] ..... F23M 3/00

[52] U.S. Cl. ..... 431/9; 239/400

[58] Field of Search ..... 239/404–406, 239/400, 5, 8, 11; 431/9, 10, 351, 352, 348

[56] References Cited

U.S. PATENT DOCUMENTS

| | | | |
|---|---|---|---|
| 2,515,845 | 7/1950 | Van Den Bussche | 431/9 |
| 3,212,558 | 10/1965 | Williams | 431/348 |
| 3,401,883 | 9/1968 | Gebhardt et al. | 239/406 |
| 3,576,384 | 4/1971 | Peczeli | 239/405 |
| 3,870,456 | 3/1975 | Graat | 239/400 |
| 3,945,574 | 3/1976 | Polnauer | 239/404 |

FOREIGN PATENT DOCUMENTS

| | | | |
|---|---|---|---|
| 920051 | 1/1973 | Canada | 431/9 |

*Primary Examiner*—Andres Kashnikow
*Assistant Examiner*—Michael J. Forman
*Attorney, Agent, or Firm*—Edwin E. Greigg

[57] ABSTRACT

A process and apparatus for atomizing and burning liquid fuels, according to which a primary gas is introduced into a vortex sink flow having a light swirl and entering the combustion space in the region of its sink through an opening in a front surface. The swirl of the vortex sink flow is so great that it will hug the front surface as a wall jet due to the Coanda effect while the swirl is maintained. The fuel is introduced into at least one region of the swirling flow where a good atomizing effect exists.

18 Claims, 7 Drawing Figures

PROCESS AND APPARATUS FOR ATOMIZING AND BURNING LIQUID FUELS

This is a continuation of application Ser. No. 839,060 filed Oct. 3, 1977, now abandoned, which is a continuation of Ser. No. 678,634, filed Apr. 20, 1976, now abandoned.

CROSS-REFERENCE TO RELATED PRIOR ART

There are no patents or printed publications having a bearing on the patentability of the present invention, but of interest are the following:

U.S. Pat. No. 2,515,845 to Van Den Bussche, J. K. J.
U.S. Pat. No. 3,401,883 to Gebhardt
U.S. Pat. No. 3,576,384 to Pelzeli, Charles F.
U.S. Pat. No. 3,870,456 to Graat, Johannes W.
U.S. Pat. No. 3,945,574 to Polnaur, Frederick F.
U.S. Pat. No. 920,051, Canada, to Tudor, Lloyd D.
U.S. Pat. No. 1,565,844, British, to Coulon, Christian
Reattachment of a Two-Dimensional, Incompressible Jet to an Adjacent Flat Plate, The Aeronautical Quarterly, Vol. 11, p. 201–232, August 1960, Bourque, C. and Newman, B. G.
Brennst.-Warme-Kraft, Vol. 30, Nr. 8, p. 311–324, August 1978, Coulon, Christian.

None of the above references, whether viewed singly or in combination with each other, are believed to have a bearing on the patentability of any claim of this invention.

BRIEF SUMMARY OF THE INVENTION

The invention relates to a process for atomizing and burning liquid fuels, such as preheated heavy oil, fuel oil, liquefied combustible gases etc., preferably for light, volatile fuels, for example for kerosene, gasoline or similar fuel, in the combustion chambers of furnaces, internal combustion engines, thermal engines, jet engines, flame starting systems or similar equipment using at least 1 dual-fluid swirling-flow burner nozzle connected to a source of pressurized gas serving as primary gas, preferably compressed air as the primary air, and a fuel source, with the primary gas serving to atomize and to prepare the fuel of which at least a major proportion is burnt by means of secondary air or other oxidizing gas (secondary gas) admitted into the combustion space, and apparatus to implement said process and a further application of the novel swirling-flow nozzle.

Known methods of this kind provide for a flame in which a closed area return-flow zone occurs which is the only effective return-flow zone in the combustion space. The flame generally is of pear-shape unless flame-sustaining devices are employed to change this shape. As a rule, flame-sustaining devices are necessary in order to stabilize the flame. Even so, flame stability is not normally particularly high. Also, it can hardly be avoided that at least some yellow flame zone occurs so that the flame is not blue throughout which would be more favorable for complete combustion. Furthermore, it is invariably necessary to provide relatively long combustion chambers which call for a considerable amount of space. Apart from this, equipment of this type is not adapted for many uses but can be used only for specific applications, such as for specific furnaces or specific internal combustion engines or specific jet engines etc., entailing different designs and operating modes to suit the particular job. Moreover, their exhaust gases contain a relatively high amount of pollutants and combustion efficiency leaves much to be desired in most cases.

OBJECT AND SUMMARY OF THE INVENTION

It is an object of the present invention to provide a method whereby the abovementioned disadvantages are avoided, which is versatile in its uses, which covers a wide operating range, which can be translated into practice with relatively simple and reliable apparatus, which affords a high combustion efficiency, a highly stable combustion over a wide stability range, preferably with a blue flame throughout, which minimizes pollutant emission and which also affords other advantages. This objective is attained by means of the features defined in claim 1.

As a result of the high-intensity swirl of the primary air produced by the low-loss vortex-sink flow and the Coanda effect which causes the flame to hug the burner front, a highly stable wall stream-jet type swirling flame is obtained, preferably of cup shape without the need for flame-sustaining devices. In addition, there is a most effective open return flow of relatively large areas directed towards the swirling flame and returning products of combustion from the combustion chamber to the swirling flame for renewed combustion caused by the negative pressure produced by the vortex-sink flow. This permits good performance with substantially shorter lengths of the combustion chamber where this is at a premium. It is furthermore possible to control the length and diameter of the swirling flame simply by varying the pressure and/or flow rate of primary air and/or secondary air. Due to the unusually wide stability range of the swirling flame, a wide operating range is obtained within which different fuel/compressed air mixtures may be used. It is possible to obtain blue flames throughout. The burner noise level is lower than in existing burners. Due to the high flow velocity of the primary air it is possible at least in many cases to operate at low fuel supply pressures and, in some cases even without a delivery pressure, i.e. one can have the fuel drawn in by the negative pressure caused by the vortex-sink flow at the fuel discharge hole or holes possibly only after ignition. This will result in a particularly high reliability and low fire risk because the fuel delivery system is less liable to develop leakages as a result of the low pressure level. The method according to the invention furthermore makes it possible to achieve a very high fuel atomizing performance. For example, it has been found in tests by means of holography using water instead of fuel that an aerosol was obtained with a mean droplet size of as small as approximately $6 \cdot 10^{-3}$ to $8 \cdot 10^{-3}$ mm so that mean droplet sizes of less than 0.01 mm are readily achieved. This enables an exceptionally high combustion efficiency to be attained which is assisted in particular by the open return flow. A specially high fuel atomizing performance can be achieved by the feature covered by claim 2.

In a preferred development of the invention it is proposed that the fuel is sprayed or injected in the form of a thin jet in the shape of a truncated cone from the longitudinal axis of the sink into the swirling flow whereby a particularly uniform distribution of the fuel is obtained.

The fuel jet or jets emitted may be extremely thin so that complete combustion is effected within short times in the regions of high temperatures in the flame which result in a reduction of obnoxious exhaust gas constituents, such as hydrocarbons, carbon monoxide etc.

Furthermore, the atomizing performance attainable is apt to benefit from the use of maximum flow velocities of the primary air swirling flow in the region of the fuel jet or jets close to the speed of sound. It may be feasible also to adopt supersonic velocities.

To implement the method according to the invention, apparatus is proposed with the features set out in claim 8. It is readily possible with this type of apparatus or rather it is a normal effect that the swirling flame will not directly contact any part of the swirl nozzle due to the face that the Coanda effect causes the cool primary gas, which is not yet involved in the combustion, to hug the combustion-chamber-side face of the burner front so that the swirl nozzle will assume only relatively low temperatures and does not normally require separate cooling means and thereby will have a long overhaul life without choking by carbon deposits. A further asset of the apparatus according to the invention is in the straightforward, robust and reliable design with a long life expectancy. The apparatus can be applied not only to the combustion chambers of furnaces, internal combustion engines, thermal engines, jet engines for aircraft and rockets but also to flame igniters for starting of internal combustion engines in cold weather and/or for quick warming up of, say, armored vehicles, and it has numerous other applications.

In order to cause the swirling flow of the primary air to hug the combustion-chamber-side face of the burner front with the aid of the Coanda effect as a wall swirl jet over as short a distance as possible from the axial direction prevailing in the sink, the feature outlined in claim 10 has proved to be a special advantage.

The burner front plate may preferably be very thin so that the swirling flow is deflected at the opening of the front plate along a short path. The combustion-chamber-side surface of the front plate may preferably start right at the opening through which primary air is admitted into the combustion chamber. In some cases, however, it is conceivable that the opening admitting primary air into the combustion chamber is provided in a member inserted into an opening of the front plate. The combustion-chamber-side surface of the front plate may be of any suitable shape. In some cases, it may be flat. Mostly, however, a three-dimensional shape will be advantageous and, preferably, it can be in the shape of a truncated cone or have a region of truncated-cone shape. The opening angle of the truncated cone may suitably be 140° to 160°, preferably approximately 150° but, if necessary, smaller or wider opening angles or alternative three-dimensional surfaces may be used.

In the preferred embodiment the combustion-chamber-side surface of the front plate is rotation-symmetrical and, where additional combustion-chamber-side surfaces of the nozzle should be provided, which need not normally be the case, these may also be rotation-symmetrical. In some instances, the combustion-chamber-side surfaces of the swirl nozzle may be other than rotation-symmetrical if this is called for by special conditions.

The fuel discharge opening or openings may in many cases advantageously be in the form of rotation-symmetrical holes (drilled or bored holes) and in other cases may be of non-circular shape, preferably slot-shaped, frequently an annular slot will be suitable, and may be designed for exceptionally good results as sprayer nozzles, preferably as an annular nozzle, in a manner that a fuel reaches zones of maximum flow velocity in the swirling flow of the primary air downstream and behind its sink where it will be finally atomized. If these fuel discharge openings are designed as atomizing nozzles, these should for good performance afford an action that will enable the atomized fuel droplets to reach also as far as the zones of maximum flow velocity of the primary air to be atomized again there. Apparatus may preferably be designed so that the swirling flame produced in the form of a wall jet has approximately the shape of a pot or cup whereby a constant open return flow across a relatively large area exists into the "swirl flame cup". The bottom of the "swirl flame cup" may for good results essentially be formed by the flame front and a reaction zone of low combustion intensity whereas the perimeter of the swirl flame cup may essentially consist of a reaction-intensive combustion zone. In order to protect the fuel supply means from high temperatures and, thereby, control fire risks better than hitherto and to improve operating reliability, it may according to a feature of the invention be arranged inside the primary pressurized gas duct. This also enables cooling to be obtained, where necessary, of the fuel supplies and an effective protection under conditions of high ambient temperatures. This arrangement is also a special asset with respect to the swirling flow of the primary gas or primary air produced in the nozzle tip with the aid of a vortex-sink flow and the central admission of the fuel. In the case of heavy oil or similar fuels which require heating this arrangement is also adapted to heat the fuel, when the primary gas would be supplied at a suitable temperature, for instance by compressing the primary gas, in order to heat the fuel.

Apparatus according to the present invention may not only be used for the atomization and subsequent combustion of liquefied fuel gases or liquid fuels but, in view of its good atomizing performance, also for the production of aerosols by very fine atomization of liquid media and mixing with gases without combustion. These applications may arise, in particular, in the chemical industry, in the manufacture of medicinal drugs and generally in process engineering.

The invention is explained in greater detail hereunder on the basis of a preferred embodiment shown in the drawing.

DESCRIPTION OF THE PREFERRED EMBODIMENT

Figure 1:
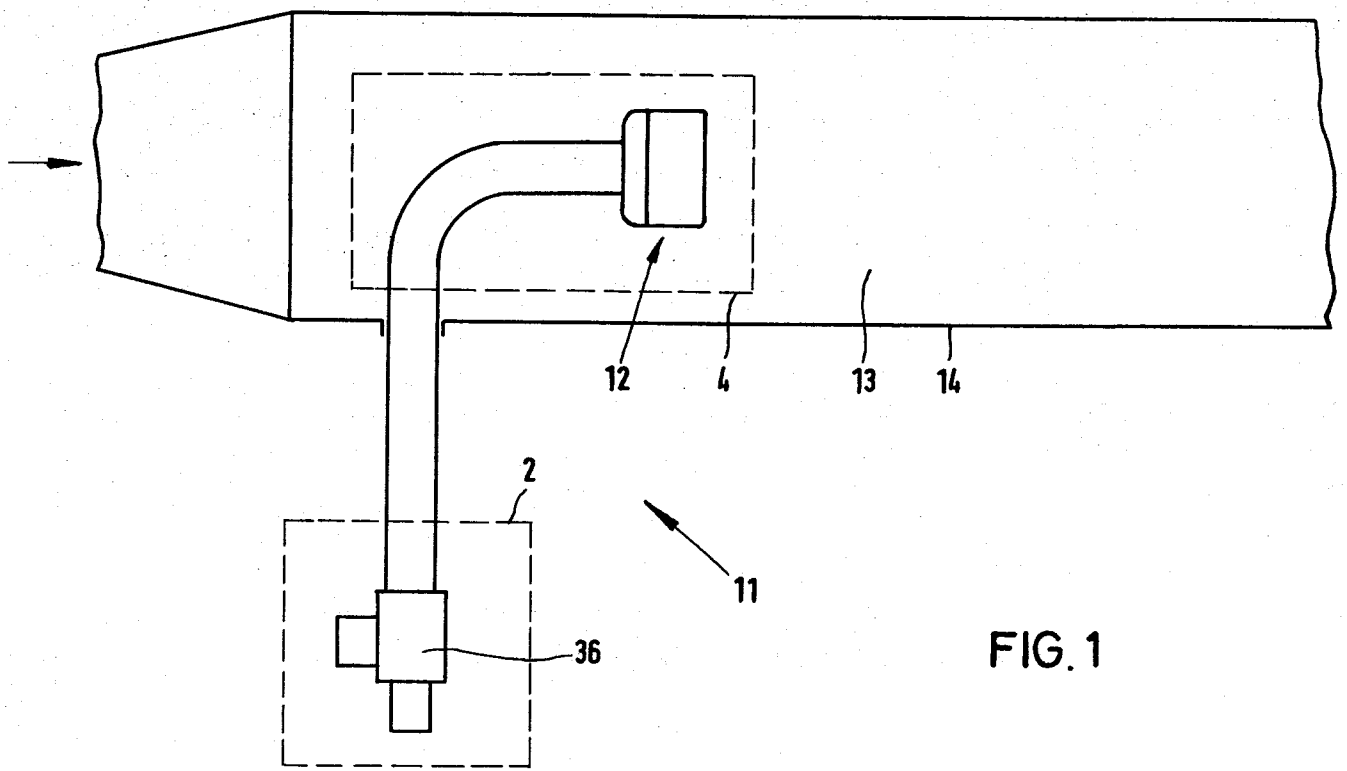
FIG. 1 is a schematic, partly sectioned, elevation of a typical embodiment of the invention.
Figure 2:
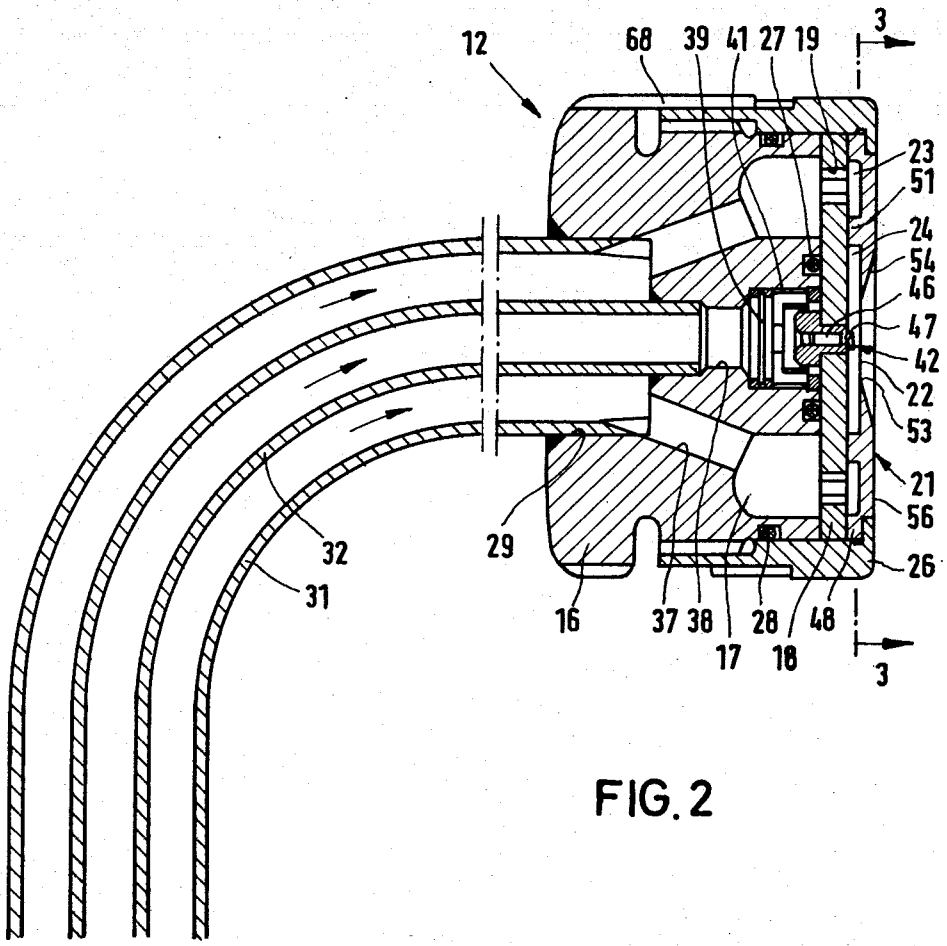
FIG. 2 is a true-to-scale longitudinal section through the part of the apparatus defined by the dashed outline 4 in FIG. 1 which is arranged in the combustion chamber.

The apparatus as illustrated in FIG. 1 comprises a dual-fluid swirling-flow burner nozzle 12 which is arranged in, and coaxially with, the combustion chamber 13 preferably formed by an essentially cylindrical tube 14. Secondary air or another oxidizing gas acting as gaseous oxygen source for the combustion of fuel is admitted into the combustion chamber 13 in an axial direction between the swirl nozzle 12 which in the embodiment illustrated has a circular outer perimeter as is preferred, and the wall of the tube 14. Admission may be forced by means of pressure or by induction. As can be seen from FIG. 2, the swirl nozzle 12, which is essentially of rotation-symmetrical shape, consists of a nozzle body 16 provided with an annular groove 17, a flat plate 18 provided with two concentric rows of axial holes 19 which covers the nozzle body 16 at the end of the open side of the annular groove 17, a front plate 21 having a central circular opening 22 which is in contact with plate 18 and forms an annular space 23, and a collar nut 26 secured by a retainer 68 against turning and which collar nut is screwed to the nozzle body 16 in order to provide axial and radial fixing of the plate 18 and the front plate 21 to the nozzle body. A seal 27 is provided between the nozzle body 16 and the plate 18 in an axial ring groove of the nozzle body 16 and a seal 28 is provided between the collar nut 26 and the nozzle body 16 in a radial ring groove of the nozzle body 16. Said collar nut 26 has an additional function in providing rotation-symmetrical location of the front plate 21, the flat plate 18 and the nozzle body 16 relative to each other.

Figure 4:
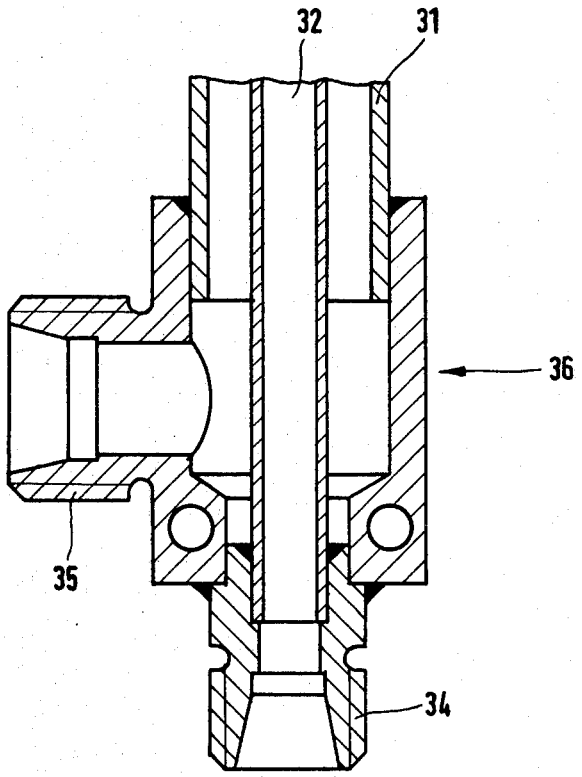
FIG. 4 is a longitudinal section through the connecting part of the apparatus defined by the outline 2 in FIG. 1, FIGS. 5*a* and 5*b* are each an enlarged identical schematic representation of the flow conditions during operation with a blue swirling flame in the apparatus delineated in FIGS. 1 to 3, the diagram in FIG. 5*a* being lettered and in FIG. 5*b* being unlettered.

Inserted into a central hole 29 of the nozzle body 16, there is a primary gas duct 31 e.g. a pressurized primary air pipe, of preferably circular/cylindrical shape. Furthermore, there is a pipe 32 of circular/cylindrical cross section installed in a smaller central hole 38 of the nozzle body 16, which pipe is connected to a fuel storage tank not shown in the diagram. The pipe 31 is connected to a pressure gas source not shown in the diagram, preferably a pressurized air source acting as primary gas source, and arranged preferably coaxially in it is the pipe 32 so that it is enveloped by primary gas. The pipes 31 and 32 are provided at their ends opposite to the nozzle body 16 with a connecting member 36 (FIG. 4) which, by means of its two connections 35 and 34 which are perpendicular to each other, are connected to a pressurized gas source, such as a fan, compressor or similar equipment, and to the fuel storage tank respectively, via further connecting lines which may be of the flexible type.

The primary gas admitted, which may preferably be air, can be supplied at the pressures usually adopted for such equipment, for instance, two to three kgf/cm$^2$g. Generally, the fuel requires only relatively low delivery pressures or can even be drawn out by the swirl nozzle. Instead of the primary air, another pressurized gas can be used in many instances which need not necessarily contain oxygen. The fuel may be, for instance, preheated heavy oil, fuel oil (Diesel oil), kerosene, gasoline, liquefied combustible gases or similar fuels.

The pipe 31 is connected via a circular row of holes 37 in the nozzle body 16 which are inclined at an acute angle to the longitudinal axis of the nozzle body with the annular groove 17. The pipe 32 for the fuel enters the central hole 38 of the nozzle body 16 which has a cylindrical extension in which are arranged a fuel filter 39 and a spacer 41 locating the filter 39. A nozzle tip 42 is inserted with a cylindrical neck in a central hole in the plate 18 to provide an interlocking connection and is retained there to contact the bottom of plate 18 with a collar. The nozzle tip 42 which, with the exception of ports 47 serving for the emission of fuel, is rotation-symmetrical and whose axis coincides with the axis of the nozzle body 16, has a central hole 46 which communicates with the pipe 32 and, in the end region of the nozzle tip 42 which is of truncated-cone shape and projects beyond the plate 18 opens into a plurality, preferably 3, diverging spray ports or openings 47 which penetrate through this end area whose spray directions 45 (FIG. 5*b*) are inclined to the longitudinal axis of the nozzle body 16 and from which the fuel is emitted in very thin jets. The spray ports 47 for the fuel may be circular. Where necessary, a single annular fuel discharge opening may be provided, for instance, in the shape of a conical annular port. The fuel discharge openings may also be provided at alternative points, for instance, in the plate 18 or in the front plate 21.

The holes 19 serve for the axial admission of the primary gas into the annular space 23 and additionally act as rectifying devices for the primary gas flowing through them. The circle diameter of the inner row of holes 19 roughly corresponds to the diameter of the imaginary center circle of the annular groove 17 whereas the outer row of holes is disposed approximately centrally between the inner circle and the outer rim of the annular groove 17.

Figure 3:
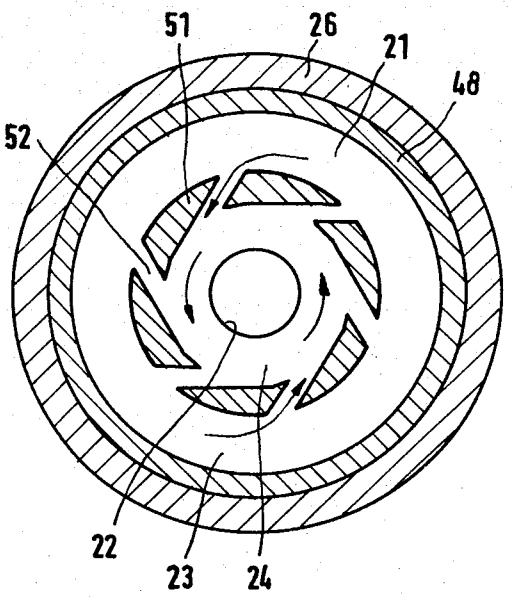
FIG. 3 is a part section through FIG. 2 viewed along the line 3—3 in FIG. 2.

The front plate 21 has a ring-shaped projection 48 arranged circumferentially on its underside facing the plate 18 with which it rests on the plate 18 and to which the collar nut 26 is applied. Furthermore, the front plate 21, as can be specifically seen from FIG. 3, is provided on its underside with projecting guiding members 51 disposed on a circular pattern around the opening 21 at a distance from the latter which guiding members 51 serve to produce an intensive swirling flow for which purpose guiding passages 52 exist between adjacent guiding members 51. The guiding passages 52 are directed helically inwards and are of a height which in this preferred embodiment corresponds to the height of the guiding members 51. The guiding members 51 whose height for good performance corresponds to the height of a central swirl space 24 which they confine circumferentially and in which the guiding members generate a very high swirl flow of the primary air, are in contact with the plate 18. The diameter of the geometrical outer envelope of the guiding body 51 is large enough for the two circles of holes 19 to enter the annular space 23 between it and the ring-shaped projection 48. The diameter of the geometrical inner envelope of the guiding bodies 51 is preferably substantially greater than the diameter of the opening 22 in the front plate 21 so that, viewed from the front plate 21, the swirl space 24 is formed as a recessed central and flat space 24 having the opening 22. The rim of the central opening 22 in the front plate 21 is fashioned as a circular sharp edge 53 and forms the inner perimeter of a truncated-cone-shaped outer surface area 54 of the front plate 21 facing the combustion space whose opening angle is approximately 140° to 160° and, preferably, approximately 150°. Adjoining this truncated-cone-shaped area 54, there is a flat and plane annular area 56 extending peripherally and perpendicular to the longitudinal axis of the nozzle 12 and, consequently, also perpendicular to the longitudinal axis of the combustion space 13 which area 56 is for good performance flush with the end of the collar nut 26. The primary gas admitted to the nozzle 12 through the pipe 31 passes through the holes 37 into the annular groove 17 and from there through the holes 19 into the annular space 23 and has imparted to it an intensive flat swirling motion flowing from the outside towards the inside, as shown by the arrows in FIG. 3, in the annular space 23 by the action of the guiding members 51 and the guiding passages 52. For this purpose, the guiding members 51 are fashioned and arranged approximately like blades as shown, the shape delineated in FIG. 3 having proved to be particularly advantageous with the gas entering the swirl space 24 substantially tangentially although alternative shapes may be adopted. As a result, the primary gas in the central swirl space 24 has a high swirl with a radially inwards directed flow component. In this preferred embodiment, the primary gas has a flow pattern along the edge 53 of the opening 22 which is substantially parallel to the edge 53.

At this opening 22, the swirling flow has a sink because it passes through this opening 22 into the combustion space 13 with the high swirl being maintained so that this flow may be described as a vortex-sink flow. Downstream of this opening 22, it will form a three-dimensional swirling flow with a radially outwards directed component and, in consequence of the Coanda effect, it will hug the front plate 21 on its outside roughly at 58 (FIG. 5*b*) whereby a closed circulator flow 59 exists between the circular edge 53 and the point 58.

The liquid fuel is emitted from the opening 47 into a region 61 of the swirling flow of the primary gas where there is a maximum atomizing effect. To this end, the most favourable results are obtained if the fuel is discharged or, if necessary sprayed into regions of maximum flow velocity and/or maximum flow gradients of the swirling flow. In this typical embodiment, the region 61 is located downstream of the sharp edge 53 close to it in the combustion space as is shown at 61 in the flow diagram of FIG. 5*b*. In many cases, it may be sufficient for the fuel to be discharged or sprayed into the vicinity of the edge of the opening 22 in the front plate 21 into the swirl space 24 because there are very high flow velocities and/or high velocity gradients at that point. In an embodiment not illustrated the fuel discharge openings are located in the front plate 21.

As a result of this high flow velocity or the high rate of velocity change in the swirling flow, the liquid fuel emitted in thin jets is entrained and finally atomized whereby droplets sizes of less than $10^{-2}$ mm are obtainable.

The pressurized air and the fuel may preferably have a weight ratio of approximately 1:1 to 7:1.

Figure 5A:
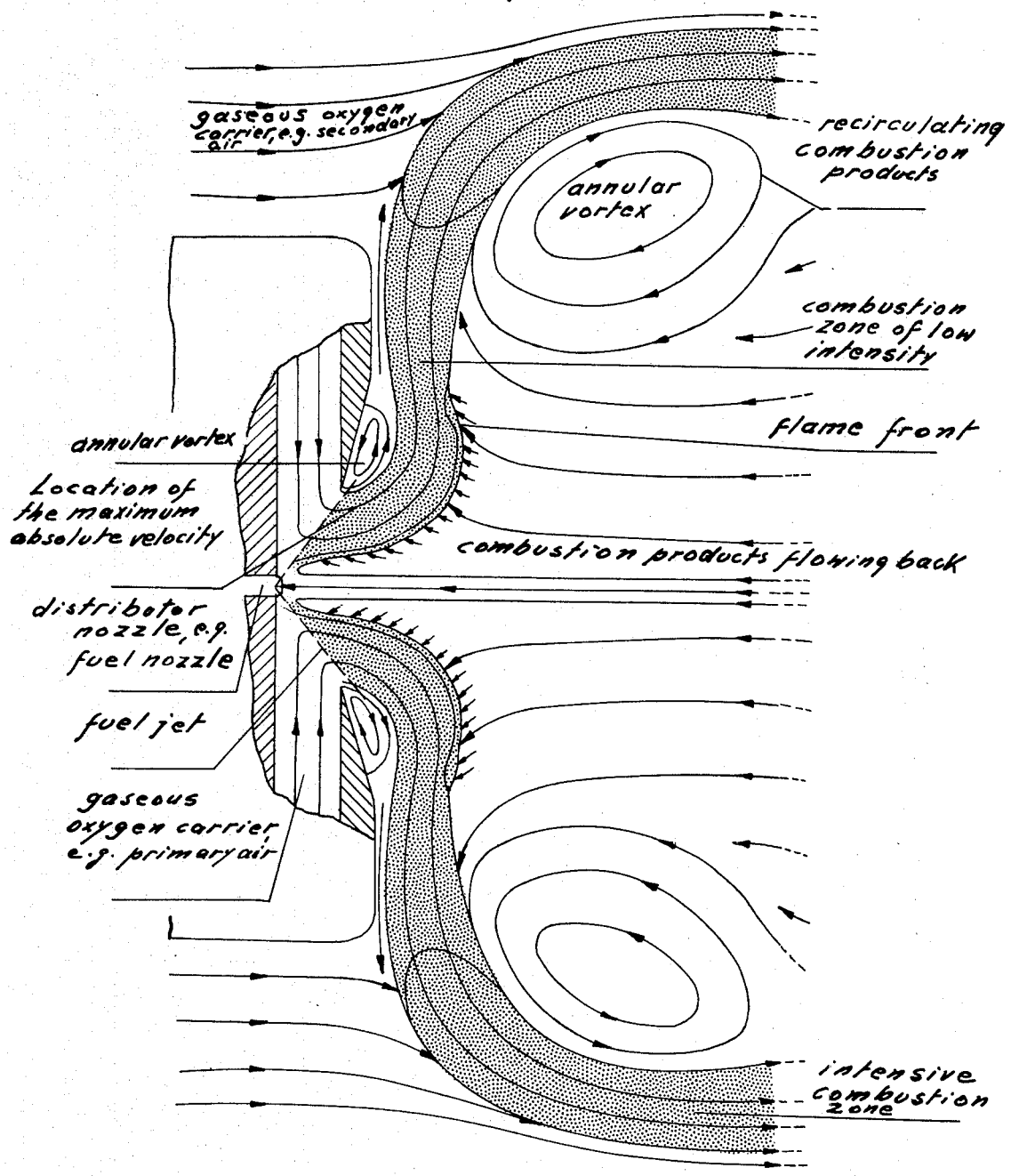
Figure 5B:
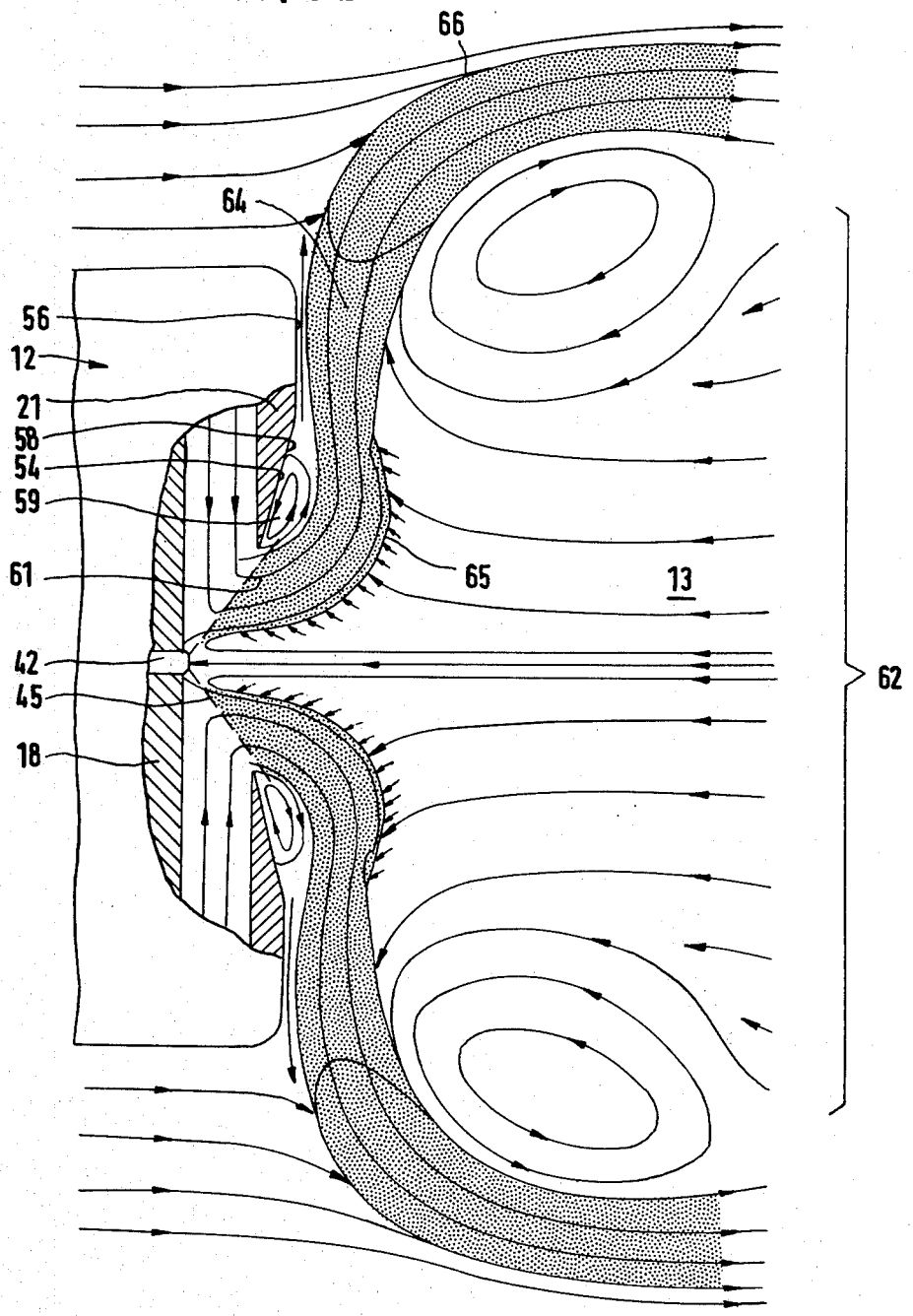
Figure 6:
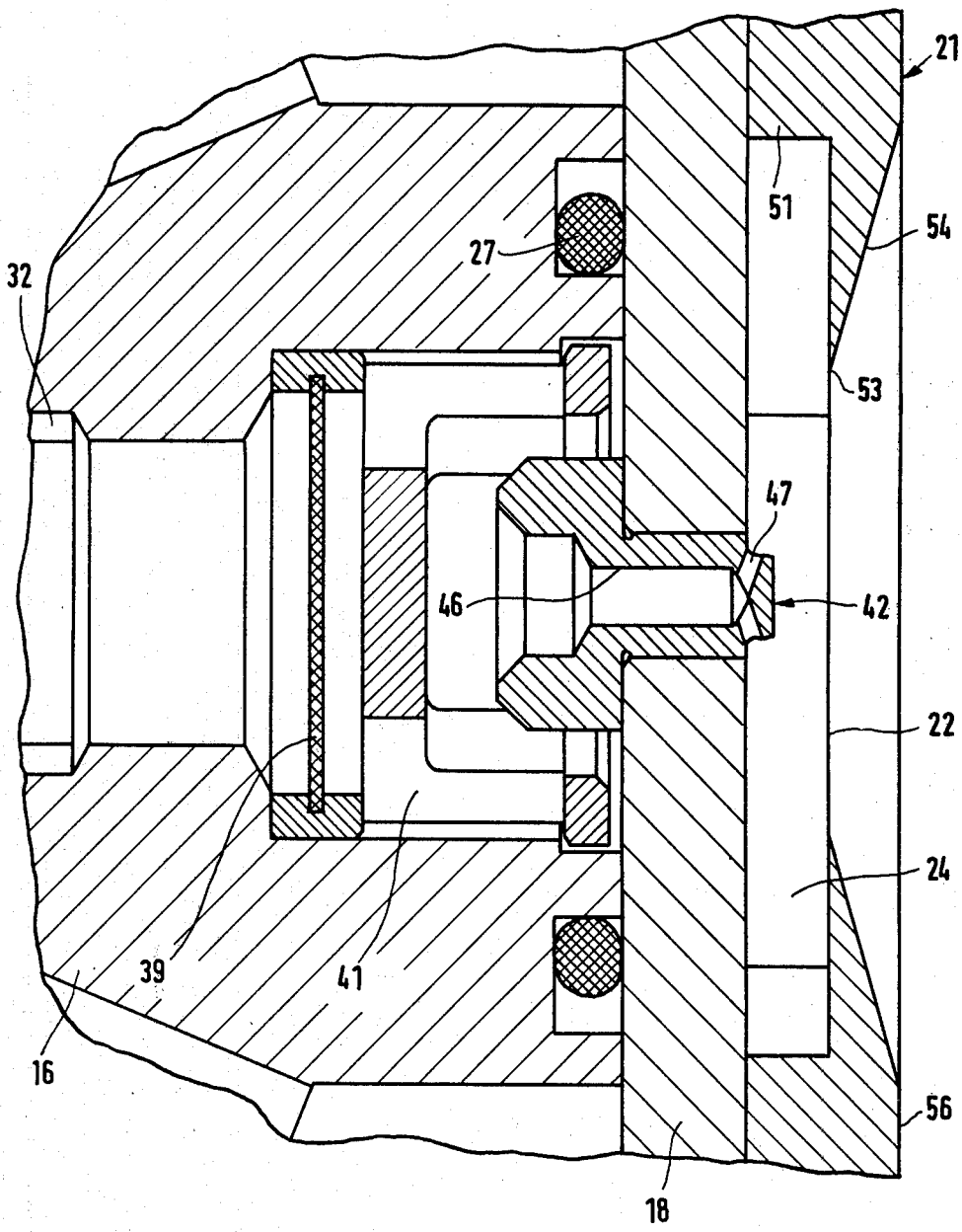
FIG. 6 is an enlarged detail of FIG. 2.

As can be seen from FIG. 5*a*, the swirling flame in this preferred embodiment will not contact the front plate 21 because this front plate, if it consists of metal, will be continuously cooled on its inner surface facing the swirl space 24 by the relatively cooler swirling flow of the primary gas and because the flame cannot adhere to the front plate on account of the outer surface of the the latter being also relatively cool. The swirling flame may be blue throughout with the flame front 65 being an intense blue while the combustion zone 64 of a lower intensity will be a weaker blue due to the fuel-rich mixture and the outer intensive combustion zone 66 will be an intense blue due to the continuous supply from the outside of secondary air (fresh air). Inside the combustion zone 66 there will be a recirculation of partly burnt combustion products in the form of a toroidal vortex. In the flame front there may be a stoichiometric air/fuel ratio. The combustion zone of low intensity may, due to a considerable amount of excess fuel, also have a yellow colour which, in general, will, however, be unfavourable, for instance, in internal combustion engines. The gases and products of combustion emitted from the swirling flame will to a substantial extent be continuously drawn back in an open flow into the swirling flame formed as a wall jet and having a cupshaped pattern to be subjected again to the combustion process as is shown by FIGS. 5*a* and 5*b*, the said return flow having a large cross sectional area and being substantially directed centrally and axially in the combustion space to the bottom of the swirling flame. Furthermore, a toroidal vortex is formed at the inner boundary of the outer intensive combustion zone. Especially when operating with a blue flame throughout, very high combustion efficiencies will be achieved and the exhaust gases will contain only relatively very low amounts of obnoxious constituents.

This large-area open return flow of the products of combustion is shown at 62 in the flow diagram of FIG. 5*b*. It assists flame stability and also enables a distinct reduction to be achieved in the emissions of toxic pollutants in the exhaust gas, above all of nitric oxides.

The swirl nozzle 12 is adaptable to other applications than combustion chambers and furnaces on account of its high atomizing performance, i.e. for the manufacture of aerosols which are not burnt.

It is, of course, to be understood that the present invention is, by no means, limited to the specific showing in the drawings, but also comprises any modifications within the scope of the appended claims.

What we claim is:

1. Apparatus for atomizing and burning fuels including feed lines for fuel and primary oxidizing gas, said feed lines terminating in a nozzle means having an apertured body portion, said primary gas feed line terminating in an annular chamber in said nozzle means, a first plate provided with at least one circle of apertures positioned in said nozzle means, a fuel jet means arranged to extend through said plate, a spray control plate having a means defining a central aperture and further including a recessed gas swirl area in communication with said apertures in said first plate, further circumferentially arranged offstanding guide members in said recessed gas swirl area capable of inducing a high degree of swirl in said primary gas with a radially inwardly directed flow component between the said guide members and said central aperture, means to secure said apertured first plate and said spray control plate to said nozzle means and said fuel jet means being affixed to said first plate and serving to introduce fuel in a direction toward the means defining the central aperture in said spray control plate, said apparatus further including a combustion chamber, said combustion chamber including means for receiving a stream of a secondary oxidizing gas and for guiding the same around said nozzle means; whereby said secondary oxidizing gas substantially combusts said fuel and whereby there takes place a substantial return flow of gases from the combustion chamber toward said nozzle means.

2. Apparatus for atomizing and burning fuels as claimed in claim 1, in which the means defining the central aperture in said spray control plate terminates in a knife-like edge.

3. Apparatus for atomizing and burning fuels as claimed in claim 2, in which said knife-like edge flares outwardly into a rotationally concentric surface that is inclined with respect to the axis of said nozzle means.

4. Apparatus for atomizing and burning fuels as claimed in claim 3, in which said rotationally concentric surface defines an included angle of approximately 140°–160° and preferably about 150°.

5. Apparatus for atomizing and burning fuel as claimed in claim 4, in which said rotationally concentric surface merges into a flat surface area provided on said spray control plate.

6. Apparatus for atomizing and burning fuel as claimed in claim 1, in which the fuel jet means is disposed centrally of said means defining said opening in said spray control plate.

7. Apparatus for atomizing and burning fuel as claimed in claim 1, in which said fuel jet means includes a terminus and aperture means which are disposed adjacent to and angularly with respect to said terminus.

8. An apparatus for atomizing and burning fuels as claimed in claim 1, in which said combustion chamber is defined by a shroud which surrounds said nozzle means.

9. A method of producing a flame from a burner nozzle providing high combustion efficiency and relatively low amounts of obnoxious constituents comprising the steps of:

(a) introducing primary oxidizing gas into a swirl area of a nozzle having a fuel jet and an outer front wall;

(b) discharging said primary oxidizing gas into said swirl area provided between said outer front wall and an inner wall, said outer front wall having a central aperture, (c) passing the swirl flow of primary oxidizing gas from said swirl area through said central aperture to said outer front wall, (d) discharging fuel from said fuel jet into a region of approximately maximal flow velocity of the swirl flow of said primary oxidizing gas so that the twist of the swirl flow is such that an annular vortex of said primary oxidizing gas and fuel is formed on a rotationally concentric surface that is inclined with respect to said nozzle, (e) igniting and forming as a flame a swirling fuel-gas mixture in a corridor adjacent to and adhering to the outer surface of said outer front wall of said nozzle by means of the Coanda effect;

(f) combusting a portion of said swirling fuel-gas mixture in a first stage adjacent said outer front wall surface;

(g) admitting a stream of secondary oxidizing gas to substantially flow around said nozzle, (h) merging with the partially combusted mixture of said primary oxidizing gas and said fuel to substantially complete the combustion of said swirling fuel-gas mixture in a second stage radially outward from and downstream of said central aperture; and (i) returning incompletely combusted products of combustion towards a combustion zone represented by said first stage for improving the combustion of said fuel-gas mixture.

10. A method of producing a flame from a burner nozzle as claimed in claim 9, in which said fuel jet has means defining at least one aperture and the fuel emitted therefrom is discharged into a region of approximately maximum velocity gradients of the swirling flow of primary gas.

11. A method of producing a flame from a burner nozzle as claimed in claim 9, in which the fuel is discharged as a truncated cone-shaped thin jet into the primary gas.

12. A method of producing a flame from a burner nozzle as claimed in claim 9, in which the weight ratio of primary gas/fuel is in a range approximately 1:1 to 1:7.

13. A method of producing a flame from a burner nozzle as claimed in claim 9, in which the maximum flow velocity of the primary gas is near the velocity of sound.

14. A method of producing a flame from a burner nozzle as claimed in claim 9, in which the maximum flow velocity of the primary gas is in the supersonic range.

15. A method of producing a flame from a burner nozzle as claimed in claim 9, in which the primary oxidizing gas is air.

16. A method of producing a flame from a burner nozzle as claimed in claim 9, in which said fuel jet has a plurality of means defining apertures and the fuel emitted therefrom is discharged into a region of maximum flow velocity gradients of the swirling flow of primary gas.

17. A method of producing a flame from a burner nozzle as claimed in claim 9, wherein step (d) includes so guiding said secondary oxidizing gas around said nozzle means that combustion of said fuel takes place and there is generated a return flow of gases from the region of combustion back to said burner nozzle.

18. A method as defined in claim 9, wherein the portion of fuel combusted by said primary oxidizing gas is less than the portion of fuel combusted by said secondary oxidizing gas.

* * * * *